US011013981B1

(12) United States Patent
OWinter et al.

(10) Patent No.: US 11,013,981 B1
(45) Date of Patent: May 25, 2021

(54) SKI POLE ACCESSORY

(71) Applicant: Skidazzler, LLC, Denver, CO (US)

(72) Inventors: Ashley OWinter, Denver, CO (US); Daniel Delli-Colli, Denver, CO (US)

(73) Assignee: Skidazzler, LLC, Denver, CO (US)

( * ) Notice: Subject to any disclaimer, the term of this patent is extended or adjusted under 35 U.S.C. 154(b) by 0 days.

(21) Appl. No.: 16/716,134

(22) Filed: Dec. 16, 2019

(51) Int. Cl.
*A63C 11/22* (2006.01)

(52) U.S. Cl.
CPC ..... *A63C 11/225* (2013.01); *A63C 11/222* (2013.01)

(58) Field of Classification Search
CPC ..... A63C 11/22; A63C 11/225; A63C 11/227; A63C 11/228
See application file for complete search history.

(56) References Cited

U.S. PATENT DOCUMENTS 1,178,165 A * 4/1916 Lupton, Jr. ..... B64C 33/00 280/810
1,618,065 A * 2/1927 Davis ..... E04H 15/003 135/96
1,859,178 A * 5/1932 Sprinkle ..... A63C 3/00 280/810
2,955,300 A 10/1960 Hedlund
3,662,433 A 5/1972 Couttet
4,065,140 A * 12/1977 Cadwalader ..... A45B 5/00 280/812
4,204,694 A * 5/1980 Freeman ..... A63C 3/00 280/810
4,402,529 A 9/1983 Cavazza
4,531,763 A * 7/1985 Toland ..... A63C 11/00 280/810
4,991,875 A * 2/1991 McDermott ..... A63C 11/00 280/816
5,359,797 A * 11/1994 Williamson ..... G09F 11/29 280/816
5,390,957 A * 2/1995 Metzler ..... A63C 11/00 280/819
5,437,755 A 8/1995 Lavorel
5,535,692 A * 7/1996 Ezzy ..... B63H 8/20 114/109
5,538,285 A * 7/1996 Goode ..... A63C 11/22 135/66
5,718,792 A 2/1998 Goode
5,845,334 A 12/1998 Marcolini, Jr.
5,924,732 A * 7/1999 Olsen ..... A63C 17/12 280/809

(Continued)

FOREIGN PATENT DOCUMENTS

EP 0499552 B1 8/1994
JP H 078594 A 1/1995

*Primary Examiner* — Jeffrey J Restifo
(74) *Attorney, Agent, or Firm* — Nixon Peabody LLP

(57) ABSTRACT

A ski pole accessory includes at least one pole connector, a supporting base, and a plurality of tapering strings forming a streamer. The supporting base has a securing element connected to the pole connector, and a length that extends along at least a majority of a pole length of a ski pole when the supporting base is attached to the ski pole. The strings are individually connected to and extending from the supporting base. The strings extend along at least a majority of the length of the supporting base with each string being offset from an adjacent string of the plurality of strings along the supporting base.

20 Claims, 3 Drawing Sheets

(56) References Cited

U.S. PATENT DOCUMENTS

| | | | | |
|---|---|---|---|---|
| 7,992,900 | B2 * | 8/2011 | Jacobs | A63C 19/062<br>280/809 |
| 8,235,424 | B2 * | 8/2012 | Garcia | A63C 11/228<br>280/819 |
| D742,465 | S * | 11/2015 | Bain | D21/767 |

* cited by examiner

SKI POLE ACCESSORY

FIELD OF THE INVENTION

The present invention relates generally to ski poles, and, more specifically, to a ski pole accessory for enhancing a ski pole.

BACKGROUND OF THE INVENTION

Ski poles are typically formed with an elongated shaft that has a handgrip at one end and a tip at the other end. Skies use the ski poles for various reasons, such as improving or controlling balance, propulsion, rhythm, accuracy, timing, and support. Skiers also use the ski poles for generating excitement on ski slopes and for distinguishing a respective skier from other skiers. For example, using ski poles in fast-speed slope runs visually enhances and highlights for ordinary observers the quickness and exhilaration of the turns. As skiing speeds vary based on individual ability and environment, ranging for example between 10 miles per hour and upwards of 150 miles per hour, visual enhancement of the skier is considered by many highly important when selecting each component of skiing equipment, and especially when selecting the ski pole.

Thus, there is a need for providing a ski pole accessory that enhances a ski pole and that prevents or reduces the above and other problems.

SUMMARY OF THE INVENTION

According to one embodiment of the present disclosure, a ski pole accessory includes at least one pole connector, a supporting base, and a plurality of strings. The supporting base has at least one securing element connected to the at least one pole connector. The supporting base further has a supporting length that extends along at least a majority of a pole length of a ski pole when the supporting base is attached to the ski pole. Each string of the plurality of strings is individually connected to and extending from the supporting base. The plurality of strings extends along at least a majority of the supporting length, with each string being offset from an adjacent string along the supporting base.

According to one implementation of this embodiment, each string of the plurality of strings has a free-moving end that extends generally parallel to the supporting base in a vertical orientation. The free-moving end extends generally perpendicular to the supporting base in a horizontal orientation. According to another implementation of this embodiment, the free-moving end moves relative to the supporting base as a function of gravity. According to yet another implementation of this embodiment, the free-moving end moves relative to the supporting base when exposed to a wind force.

According to yet another implementation of this embodiment, the plurality of strings has free-moving ends that taper in length across the supporting length of the supporting base. According to yet another implementation of this embodiment, the plurality of strings includes a first outermost string and a second outermost string between which a plurality of innermost strings are positioned. According to a configuration of this implementation, the first outermost string has a length of about 152 millimeters. According to another configuration of this implementation, the second outermost string has a length of about 610 millimeters. According to yet another configuration of this implementation, each string of the plurality of strings has a width of about 5 millimeters.

According to yet another configuration of this implementation, the supporting length of the supporting base is about 610 millimeters. According to yet another configuration of this implementation, the supporting base has a supporting width of about 26 millimeters.

According to yet another implementation of this embodiment, the plurality of strings is made from a pleather material. According to yet another implementation of this embodiment, the plurality of strings includes a variety of colors. According to an alternative configuration of this implementation, the variety of colors is selected from a group consisting of gold, silver, black, and white.

According to yet another implementation of this embodiment, the at least one connector is frictionally attachable to the ski pole. According to yet another implementation of this embodiment, the at least one pole connector includes a loop that is stretchable around the ski pole when fixing the at least one pole connector to the ski pole.

According to another embodiment of the present disclosure, a ski pole system includes a ski pole having a handgrip separated from a tip by a shaft. The ski pole further has a plurality of hooks fixed at respective positions along the shaft. The ski pole system further has a supporting base that is attached to the shaft of the ski pole in a parallel orientation. The ski pole accessory has a plurality of strings with each string being individually connected to and extending from the supporting base. The plurality of strings extends along the supporting base such that each string is offset from an adjacent string.

According to one implementation of this another embodiment, the ski pole further has a plurality of hooks fixed at respective positions along the shaft, and the ski pole accessory further having a plurality of pole connectors fixed at respective positions along the supporting base. Each pole connector of the plurality of pole connectors is coupled to a respective hook of the plurality of hooks for attaching the ski pole accessory to the ski pole. According to one configuration of this implementation, each pole connector has a loop that stretches around the shaft, the loop being secured to a respective hook of the plurality of hooks.

According to another implementation of this another embodiment, the plurality of strings includes a first outermost string, a second outermost string, and a plurality of innermost strings. The first outermost string has a shorter length than the second outermost string, and each of the plurality of innermost strings has a respective free-moving end. The respective free-moving end terminates on an imaginary line drawn between (a) a free-moving end of the first outermost string and (b) a free-moving end of the second outermost string.

Additional aspects of the disclosure will be apparent to those of ordinary skill in the art in view of the detailed description of various embodiments, which is made with reference to the drawings, a brief description of which is provided below.

Figure 1:
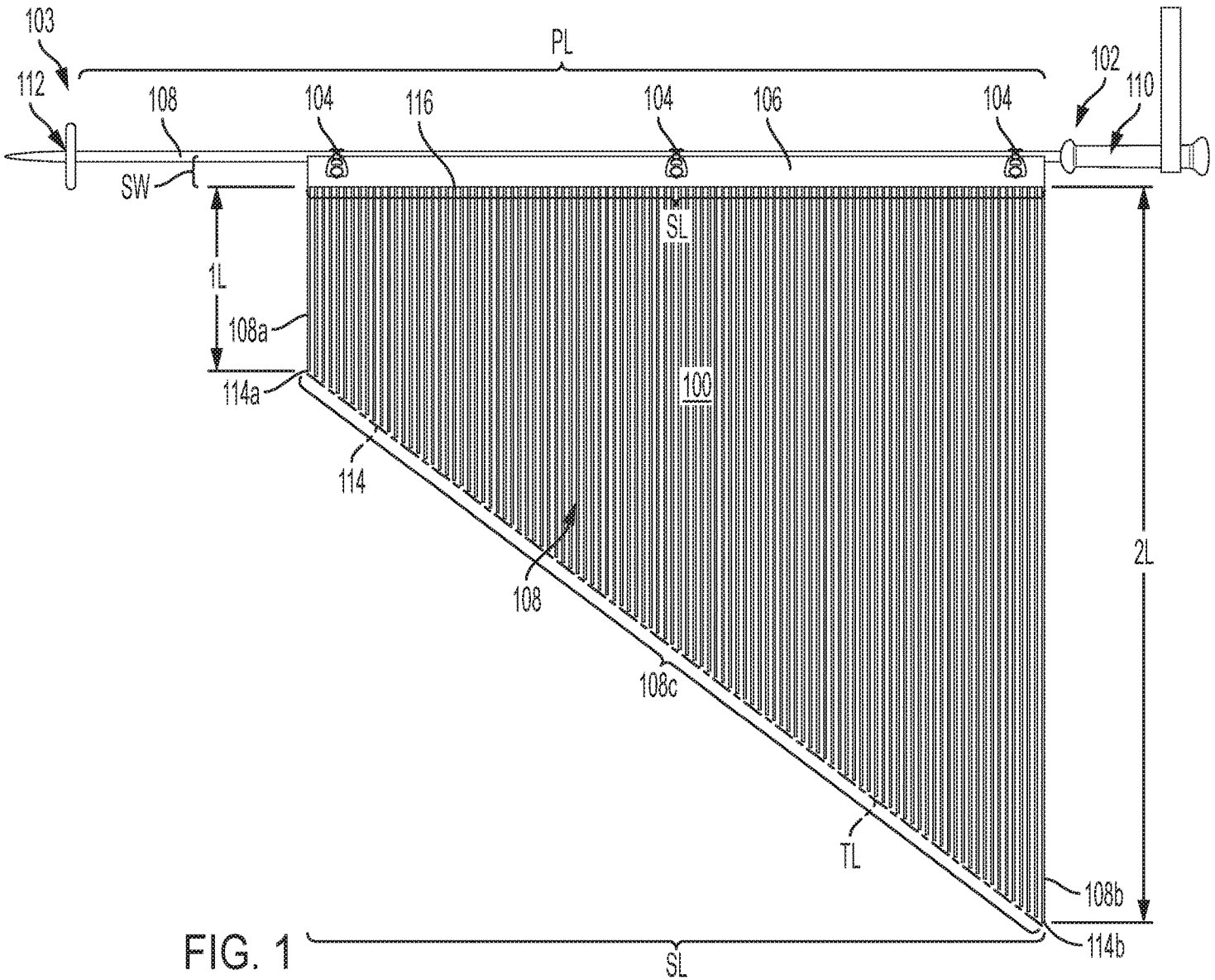
FIG. 1 is a front view illustrating a ski pole system in a horizontal orientation.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This disclosure is susceptible of embodiment in many different forms. There are shown in the drawings, and will herein be described in detail, representative embodiments with the understanding that the present disclosure is to be considered as an exemplification of the principles of the present disclosure and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed or logically prohibited: the singular includes the plural and vice versa; and the words "including" or "comprising" or "having" means "including without limitation." Moreover, words of approximation, such as "about," "almost," "substantially," "approximately," "generally," and the like, can be used herein in the sense of "at, near, or nearly at," or "within 3-5% of," or "within acceptable manufacturing tolerances," or any logical combination thereof, for example.

Figure 2:
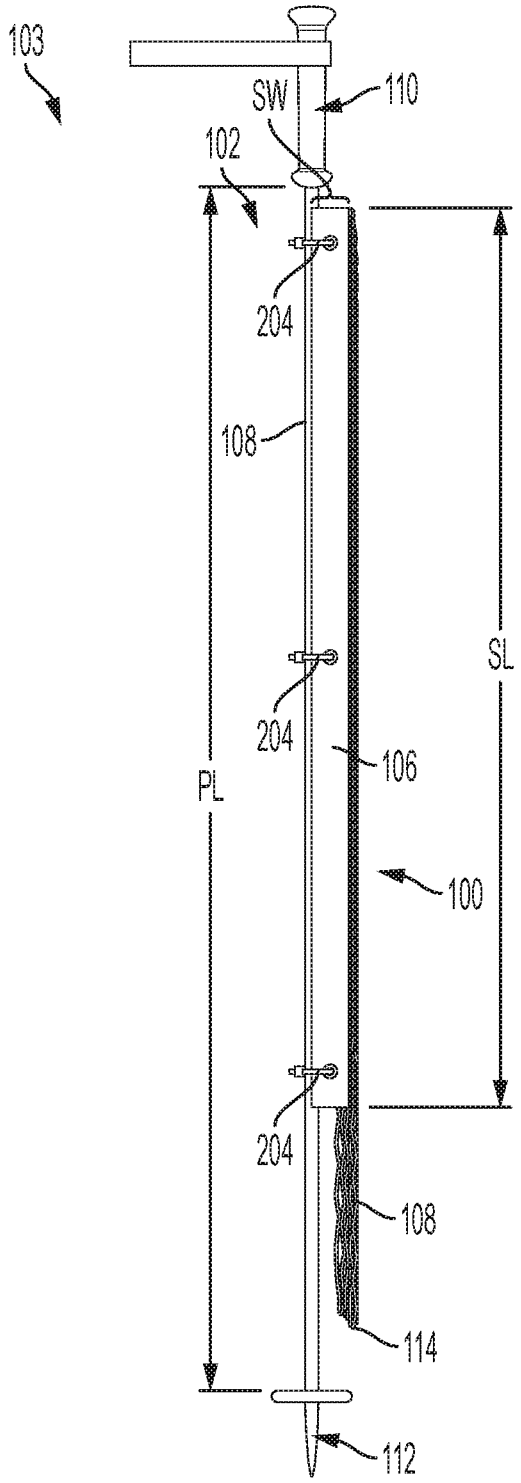
FIG. 2 is a side view illustrating the ski pole system of FIG. 1 in a vertical orientation.

Referring generally to FIGS. 1 and 2, a ski pole accessory 100 is attached to a ski pole 102 to form a ski pole system 103. According to this illustrative embodiment, and referring more specifically to FIG. 1, the ski pole accessory 100 includes three pole connectors 104, a supporting base 106, and a plurality of strings 108. A string, as used herein, refers to a flexible elongated structure such as a streamer.

In other embodiments, the ski pole accessory 100 includes a different number of pole connectors 104, e.g., a single pole connector 104 or any other number of pole connectors considered beneficial for the respective embodiment. In FIG. 1, the pole connector 104 is generally illustrated in the form of one exemplary connector in which a looped connector is secured to itself, around the ski pole 102, via a hook. In FIG. 2, an alternative embodiment shows another exemplary pole connector 204 that is in the form of a zipped tie tied to the ski pole 102. As further described below and illustrated in FIGS. 3 and 4, according to yet another exemplary embodiment a pole connector 304 is in the form of yet another connector configuration. Referring back to the illustrated embodiment of FIG. 1, the configuration with three pole connectors 104 provides an advantageous stable attachment between the ski pole accessory 100 and the ski pole 102.

The supporting base 106 of the ski pole accessory 100 is generally elongated, having a length SL (also referred to as a supporting length) that extends along at least a majority of a length PL (also referred to as a pole length) of the ski pole 102. The supporting length SL extends along the pole length PL when the supporting base 106 is attached to the ski pole 102. According to the illustrated embodiment, the supporting length SL is approximately 75% the pole length PL.

The supporting base 106 further has a width SW (also referred to as a supporting width) that extends generally perpendicular to the pole length PL when the ski pole accessory 100 is attached to the ski pole 102. Thus, the supporting length SL is generally in a parallel orientation relative to the ski pole 102, and more specifically, relative to a shaft 108 of the ski pole 102 that separates a handgrip 110 from a tip 112.

The plurality of strings 108 has each string individually connected to and extending from the supporting base 106, which collectively can form a streamer. The plurality of strings 108 extends along at least a majority of the supporting length SL of the supporting base 106. For example, according to the illustrated embodiment the plurality of strings 108 extends along the entirety of the supporting length SL.

Each string 108 is offset from an adjacent string 108 along the supporting base 106, and has a free-moving end 114 that is opposite to an attached end 116 near the supporting base 106. Each string 108 is free-flowing such that, in response to gravity, its free-moving end 114 extends generally parallel to the supporting base 106 in a vertical orientation (as illustrated in FIG. 2). Each string 108 extends generally perpendicular to the supporting base 106 in a horizontal orientation (as illustrated in FIG. 1). The free-moving end 114 flows freely based on one or more environmental and skiing factors, including, for example, gravity, wind force, skiing speed, skier posture, etc.

According to the exemplary illustrated embodiment, the free-moving ends 114 of the strings 108 have a tapered effect in length across the supporting length SL of the supporting base 106. Specifically, the strings 108 include a first outermost string 108*a*, a second outermost string 108*b*, and a plurality of innermost strings 108*c*. The first outermost string 108*a* has a shorter length 1L than a length 2L of the second outermost string 108*b*. Each of the plurality of innermost strings 108*c* has a respective free-moving end that terminates on an imaginary tapered line TL drawn between a free-moving end 114*a* of the first outermost string 108*a* and a free-moving end 114*b* of the second outermost string 108*b*.

According to a specific example, the first outermost string 108*a* has a length of about 152 millimeters (about 5.984 inches), the second outermost string 108*b* has a length of about 610 millimeters (about 24.016 inches), and the width of each string 108 is about 5 millimeters (0.197 inches). The width of each string 108 is parallel to the supporting length SL and perpendicular to the length of the respective string 108. Each of these dimensions is implemented individually or in combination with each other.

According to another example, the length ratio between the second outermost string 108*b* and first outermost string 108*a* is about 4:1, the ratio of the length of the first outermost string 108*a* to the width of each string 108 is about 30:1, and the ratio of the length of the second outermost string 108*b* to the width of each string 108 is about 122:1. Each of these ratios is implemented individually or in combination with each other.

According to yet another example, the supporting length SL of the supporting base 106 is about 610 millimeters (about 24.016 inches) and the supporting width SW is about 26 millimeters (about 1.024 inches). According to yet another example, the ratio between the supporting length SL and the supporting width is about 24:1. The dimensions and ratios disclosed above with respect to the strings 108 and the supporting base 106 are implemented individually or in combination with each other.

The plurality of strings 108 are made from one or more materials and include one or more colors. Collectively, the strings 108 can form or resemble a streamer. For example, according to one embodiment the plurality of strings 108 can be made from a pleather material that includes a variety of colors, including gold, silver, black and white. According to one example, all the strings 108 include a single color. According to another example, one or more strings 108 include a first color and one or more strings 108 include a second color. According to yet another example, at least on string 108 includes at least two colors.

The selected material is beneficially selected to provide the free flowing aspect of the strings 108, while simultaneously enduring environmental elements and providing water-resistant or waterproof protection. Accordingly, the strings can be composed of other suitable materials including pleather, leather, plastic, feathers, weatherproof or synthetic paper, and the like. The selected colors are beneficial to enhancing the ski pole 102, facilitating a dazzling effect as the skier speeds and slaloms down the ski slope.

Figure 3:
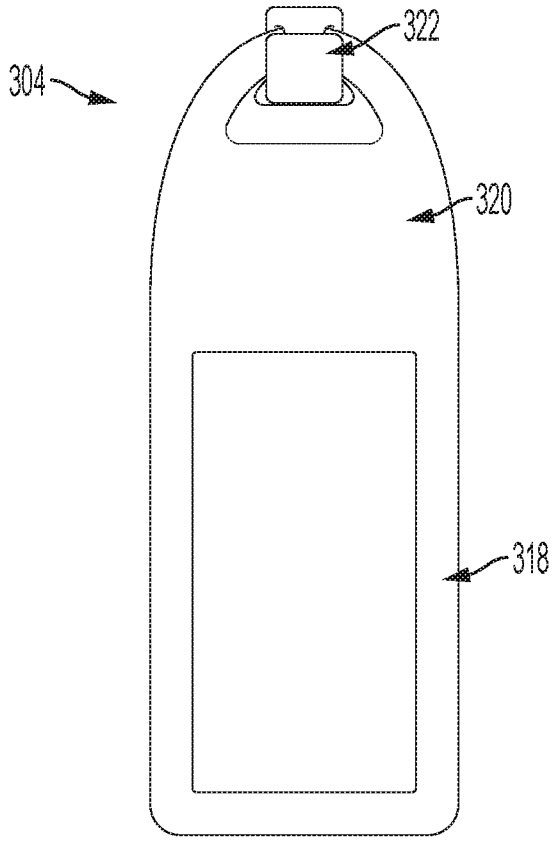
FIG. 3 is a front view illustrating a pole connector in an uncoupled position.
Figure 4:
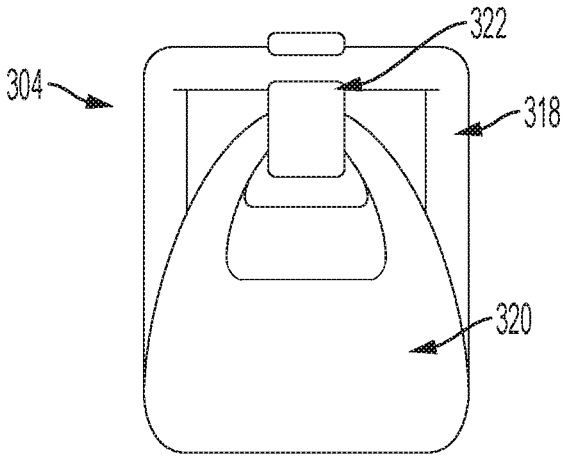
FIG. 4 is a front view illustrating the pole connector of FIG. 3 in a looped, coupled position.

Referring generally to FIGS. 3 and 4, an exemplary pole connector is illustrated in the form of another configuration 304 that has a loop 318, which extends from a main body 320. The loop 318 is stretchable to wrap (or "loop") around an object, such as the shaft 108 of the ski pole 102 (illustrated in FIGS. 1 and 2). When wrapped around the object (as illustrated in FIG. 4), the loop 318 is secured to a hook 322 that is positioned on the main body 320 and opposite to the loop 318 (as more clearly illustrated in FIG. 3).

The pole connector 304 wraps around the ski pole 102 and maintains its general position based on a frictional contact between the loop 318 and the shaft 108. For increased frictional resistance, the loop 318 is made from a gripping material consisting of silicone. Silicone is beneficial in achieving the stretching of the loop 318, as well as providing the desired frictional resistance for preventing undesired movement of the pole connector 304 relative to the ski pole 102. According to other examples, other materials are selected that provide similar stretching and frictional resistance to silicone.

According to yet another alternative example, the ski pole 102 includes respective hooks for receiving pole connectors of the ski pole accessory 100. In other words, instead of or in addition to the hook 322 of the pole connector 304 disclosed above, the ski pole 102 includes its own hooks that are either permanently or removably affixed at respective positions along the shaft 108.

When skiing on a ski slope, a skier using the ski pole system 103 displays a unique, entertaining, and useful ski pole accessory 100 that not only dazzles with its free-flowing strings 108, but also potentially protects the skier from at least some environmental factors (such as snow, water, rain, wind, etc.). Additionally, depending on the skier, the ski pole accessory 100 potentially provides an enhanced aerodynamic shape and look that facilitates improved balance and support while skiing. The aerodynamic shape provided by the ski pole accessory 100 continually and automatically (or naturally) changes as the skier proceeds down the ski slope, based on environmental factors, skier speed, and/or skier posture.

Beneficially yet, the ski pole accessory 100 does not interfere with the skier's movement or standing when the skier is in a stopped position. The strings 108 fall naturally down (due to gravity) along the ski pole 102 (as illustrated in FIG. 2) to minimize any such potential interference. Thus, somewhat similar to wings of a bird, the ski pole accessory 100 helps enhance the utility and entertainment of an otherwise traditional ski pole that is used without the ski pole accessory 100.

Each of these embodiments and obvious variations thereof is contemplated as falling within the spirit and scope of the claimed invention, which is set forth in the following claims. Moreover, the present concepts expressly include any and all combinations and sub-combinations of the preceding elements and aspects. The present disclosure is not limited to the specific illustrated example but extends to alternative embodiments other shapes and/or configurations in accordance with the knowledge of one of ordinary skill in the art applied consistent with the presently disclosed principles.

What is claimed is:

1. A ski pole accessory comprising:

at least one pole connector;

a supporting base having at least one securing element connected to the at least one pole connector, the supporting base having a supporting length that extends along at least a majority of a pole length of a ski pole when the supporting base is attached to the ski pole; and a plurality of strings with each string individually connected to and extending from the supporting base, the plurality of strings extending along at least a majority of the supporting length with each string of the plurality of strings being offset from an adjacent string of the plurality of strings along the supporting base.

2. The ski pole accessory of claim 1, wherein each string of the plurality of strings has a free-moving end that extends generally parallel to the supporting base in a vertical orientation and generally perpendicular to the supporting base in a horizontal orientation.

3. The ski pole accessory of claim 1, wherein each string of the plurality of strings has a free-moving end that moves relative to the supporting base as a function of gravity, and wherein the plurality of strings form a streamer.

4. The ski pole accessory of claim 1, wherein each string of the plurality of strings has a free-moving end that moves relative to the supporting base when exposed to a wind force.

5. The ski pole accessory of claim 1, wherein the plurality of strings has free-moving ends that taper in length across the supporting length of the supporting base.

6. The ski pole accessory of claim 1, wherein the plurality of strings includes a first outermost string and a second outermost string between which a plurality of innermost strings is positioned.

7. The ski pole accessory of claim 6, wherein the first outermost string has a length of about 152 millimeters.

8. The ski pole accessory of claim 6, wherein the second outermost string has a length of about 610 millimeters.

9. The ski pole accessory of claim 6, wherein each string of the plurality of strings has a width of about 5 millimeters.

10. The ski pole accessory of claim 6, wherein the supporting length of the supporting base is about 610 millimeters.

11. The ski pole accessory of claim 6, wherein the supporting base has a supporting width of about 26 millimeters.

12. The ski pole accessory of claim 1, wherein the plurality of strings is made from a pleather material.

13. The ski pole accessory of claim 1, wherein the plurality of strings includes a variety of colors.

14. The ski pole accessory of claim 13, wherein the variety of colors is selected from a group consisting of gold, silver, black, and white.

15. The ski pole accessory of claim 1, wherein the at least one connector is frictionally attachable to the ski pole.

16. The ski pole accessory of claim 1, wherein the at least one pole connector includes a loop that is stretchable around the ski pole when fixing the at least one pole connector to the ski pole.

17. A ski pole system comprising:

a ski pole having a handgrip separated from a tip by a shaft, the ski pole having a plurality of hooks fixed at respective positions along the shaft; and a ski pole accessory having a supporting base that is attached to the shaft of the ski pole in a parallel orientation, the ski pole accessory having a plurality of strings with each string being individually connected to and extending from the supporting base, the plurality of strings extending along the supporting base such that each string is offset from an adjacent string.

18. The ski pole system of claim 17, wherein the ski pole further has a plurality of hooks fixed at respective positions along the shaft, the ski pole accessory further having a plurality of pole connectors fixed at respective positions along the supporting base, each pole connector of the plurality of pole connectors being coupled to a respective hook of the plurality of hooks for attaching the ski pole accessory to the ski pole.

19. The ski pole system of claim 18, wherein each pole connector has a loop that stretches around the shaft, the loop being secured to a respective hook of the plurality of hooks.

20. The ski pole system of claim 17, wherein the plurality of strings includes a first outermost string, a second outermost string, and a plurality of innermost strings, the first outermost string having a shorter length than the second outermost string, each of the plurality of innermost strings having a respective free-moving end that terminates on an imaginary line drawn between (a) a free-moving end of the first outermost string and (b) a free-moving end of the second outermost string.

* * * * *